US005511606A

United States Patent [19]

Streubel

[11] Patent Number: 5,511,606

[45] Date of Patent: Apr. 30, 1996

[54] METHOD AND ARRANGEMENT FOR OPERATING A CONTINUOUS CASTING PLANT

[75] Inventor: Hans Streubel, Erkrath, Germany

[73] Assignee: SMS Schloemann-Siemag Aktiengesellschaft, Düsseldorf, Germany

[21] Appl. No.: 339,145

[22] Filed: Nov. 14, 1994

[30] Foreign Application Priority Data

Nov. 12, 1993 [DE] Germany ..... 43 38 805.1

[51] Int. Cl.[6] ..... B22D 11/06; B22D 11/08; B22D 11/128

[52] U.S. Cl. ..... 164/476; 164/483; 164/484

[58] Field of Search ..... 164/483, 484, 164/476, 417, 442, 441, 454, 413

[56] References Cited

U.S. PATENT DOCUMENTS 5,287,912 2/1994 Folder et al. ..... 164/483
5,339,887 8/1994 Flemming et al. ..... 164/476

FOREIGN PATENT DOCUMENTS 0326190 8/1989 European Pat. Off. .
62-137152 6/1987 Japan ..... 164/483

*Primary Examiner*—Richard K. Seidel
*Assistant Examiner*—I.-H. Lin
*Attorney, Agent, or Firm*—Friedrich Kueffner

[57] ABSTRACT

An arrangement for operating a continuous casting plant for the manufacture of thin slabs for hot strip rolling includes at least one pair of reducing rolls which follow a continuous casting mold. Adjustable strand guide elements are arranged following the pair of reducing rolls. A method of operating the continuous casting plant includes adjusting the pair of reducing rolls, after a predetermined length of the hot strand has traveled through the pair of reducing rolls, to a smaller gap between the reducing rolls which causes the liquid phase to be squeezed off, and deforming the hot strand by means of the pair of reducing rolls to a start-up size which has a thickness which is smaller than the thickness of the desired final size, and subsequently adjusting, preferably successively, the strand guide segments and the pair of reducing rolls to the thickness of the final size as soon as the start-up size having the smaller thickness has completely reached the range of adjustment of the respective strand guide segments and the pair of reducing rolls.

7 Claims, 3 Drawing Sheets

METHOD AND ARRANGEMENT FOR OPERATING A CONTINUOUS CASTING PLANT

BACKGROUND OF THE INVENTION

1. Field of the Invention

The present invention relates to a method and an arrangement for operating, particularly for starting up, a continuous casting plant for the manufacture of thin slabs for hot strip rolling. The arrangement includes at least one pair of reducing rolls which follow the continuous casting mold. Adjustable strand guide elements are arranged following the pair of reducing rolls.

2. Description of the Related Art

For the manufacture of a steel strip by deforming a cast strand or a thin slab, EP-B1 0 326 190 discloses a plant which includes a continuous casting machine with an oscillating open-ended mold and cooled walls and a deforming unit for the strand which includes a pair of reducing rolls and is arranged at the outlet of the mold. Accordingly, the continuously cast strand, which is composed of a solidified strand shell and a liquid core, is reduced in its thickness in a rolling deformation and is subsequently rolled. The funnel-shaped, oscillating open-ended mold has an outlet cross-section with a thickness of 40 to 50 mm; after leaving the mold, the cast steel strip of appropriate thickness is pressed together by the pair of reducing rolls to such an extent that the inner walls of the strand shells which have already solidified in the mold are welded together. The thickness reduction of the steel strand which has not yet fully solidified by means of the pair of reducing rolls of the deforming unit, and at least one roll stand following the deforming unit, make it possible to achieve steel strip which have a thickness which is substantially below 25 mm, depending on the casting speed and the pressing force of the pair of reducing rolls. Any differences in strip thickness which may occur behind the pair of reducing rolls due to changed casting speeds can be compensated by adjusting the pressing forces of the reducing rolls.

SUMMARY OF THE INVENTION

Therefore, it is the primary object of the present invention to provide a method and an arrangement of the above-described type which make possible an improved casting operation, particularly a problem-free start-up and conclusion of the casting operation. In addition, thin slabs with constant thickness are to be achieved.

In accordance with the present invention, the above-described method includes adjusting the pair of reducing rolls, after a predetermined length of the hot strand has traveled through the pair of reducing rolls, to a smaller gap between the reducing rolls which causes the crater or liquid phase to be squeezed off, and deforming the hot strand by means of the pair of reducing rolls to a start-up size which has a thickness which is smaller than the thickness of the desired final size, and subsequently adjusting, preferably successively, the strand guide segments and the pair of reducing rolls to the thickness of the final size as soon as the start-up size having the smaller thickness has completely reached the range of adjustment of the respective strand guide segments and the pair of reducing rolls.

Compared to the also possible simultaneous adjustment of the entire strand guide unit, the successive adjustment minimizes the crop losses or output losses. When carrying out successive adjustments, the pair of reducing rolls is moved apart to the dimension of the final size at the earliest after the immediately following strand guide elements of the strand guide unit have been adjusted to the thickness of the desired final size.

Accordingly, the present invention proposes a completely novel concept in which squeezing off of the crater makes it possible to start or stop a continuous casting machine with a thicker casting size than the desired final size. The hot strand which is partially solidified underneath the mold is reduced in its thickness without the long sides of the strand shell being in contact and welded together; the hot strand solidifies without deformation.

The successive closing of the strand guide elements, i.e., the adjustment to the desired final size, permits the use of an open-ended mold with an outlet cross-section which has a greater thickness. This further improves the flow conditions in the mold, wherein the greater ratio of bath level surface area relative to the strand circumference further advantageously influences the lubrication conditions in the mold and, thus, results in a further improvement of the surface. In order to achieve a final size of the hot strand having a thickness of, for example, 50 mm, the outlet cross section of the open-ended mold may have a thickness of 70 mm, wherein the pair of reducing rolls deforms the hot strand to a start-up size having a thickness of about 30 mm for the successively carried out adjustment of the strand guide segments.

A further development of the invention provides that squeezing off of the crater by the pair of reducing rolls is pressure controlled and the pair of reducing rolls is positioned to the final size after the adjustment of the strand guide unit. The pressure control ensures during squeezing off that the rolls of the pair of reducing rolls follow the deviations in thickness of the thin slab or the cast steel strip.

In accordance with another proposal according to the present invention, the pair of reducing rolls are driven rolls. This makes it possible to reduce the occurring loads acting on the hot/cold strand connection from the start-up to severing of the cold and hot strand.

In accordance with a further development of the invention, at the end of casting, the end of the strand is moved into the lower portion of the mold and the strand is temporarily stopped, the pair of reducing rolls and the strand guide elements are then successively moved apart to the dimension of the mold outlet and the strand is then moved out by the pair of reducing rolls and the strand guide elements. By stopping the strand in the lower parallel portion of the mold during a duration of, depending on the thickness, approximately 30 to 60 seconds, it is avoided that liquid steel reaches the continuous casting machine from the out of the strand.

The arrangement for carrying out the method according to the present invention includes an open-ended mold and at least one pair of reducing rolls arranged following the mold. In casting direction of the strand, the pair of reducing rolls is followed by strand guide elements, pinch rolls, a bending roll and a drive unit. The arrangement further includes strand guide grids arranged immediately following the pair of deforming rolls. The strand guide segments following the strand guide grid are constructed as strand guide rolls which are adjustably mounted in segments. Constructing the strand guide elements arranged following the pair of reducing rolls as strand guide grids provides the advantage that the unsupported length of the strand can be reduced because the grids can be moved closer to the reducing rolls than strand guide rollers could. Accordingly, if strand guide grids are arranged as the first elements of the strand guide means following the pair of reducing rolls, the pair of reducing rolls are only moved apart to the dimension of the final size after the strand guide grid and the strand guide rolls of the first segment have been adjusted to the thickness of the desired final size.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
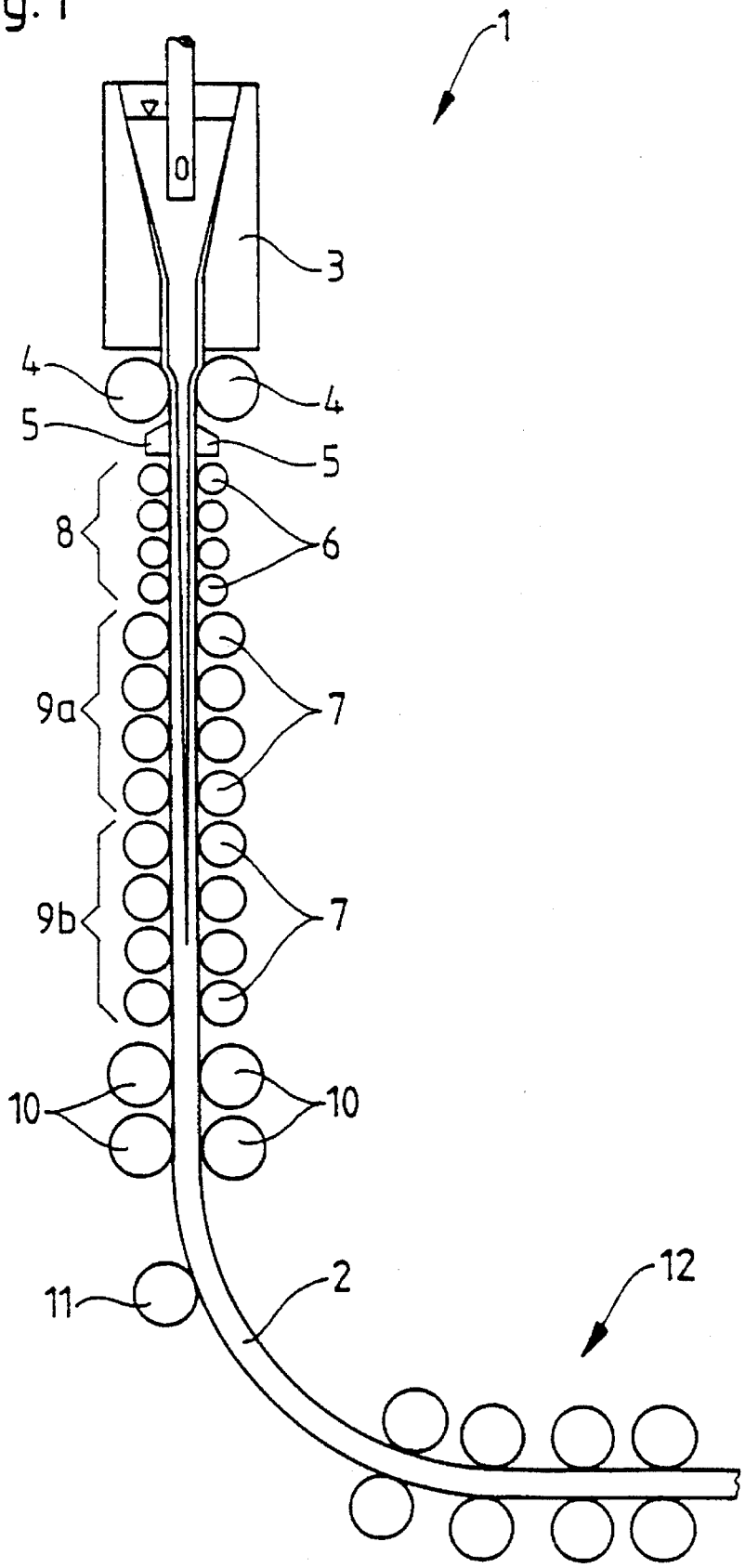
FIG. 1 is a schematic view of a plant for manufacturing thin slabs or steel strips.

As illustrated in FIG. 1, a continuous casting plant 1 for manufacturing a thin slab 2 for hot strip rolling includes an open-ended mold 3 and a pair of reducing rolls 4 arranged immediately following the mold 3. In casting direction of the strand, the pair of reducing rolls is followed initially by strand guide grids 5 and then by strand guide rolls 6 and 7 of a first strand guide segment 8 and a second strand guide segment 9*a*, 9*b*, respectively. Thus, in the illustrated embodiment, the second strand guide segment is divided into two portions 9*a*, 9*b* which each include four pairs of rolls. The strand guide segments 8 and 9*a*, 9*b* are followed by drive rolls 10 and a bending roll 11 for bending the thin slab 2. Subsequently, the thin slab 2 reaches a pinch unit 12 and subsequently enters units arranged downstream and, for this purpose, may be divided or cut by shears.

Figure 2:
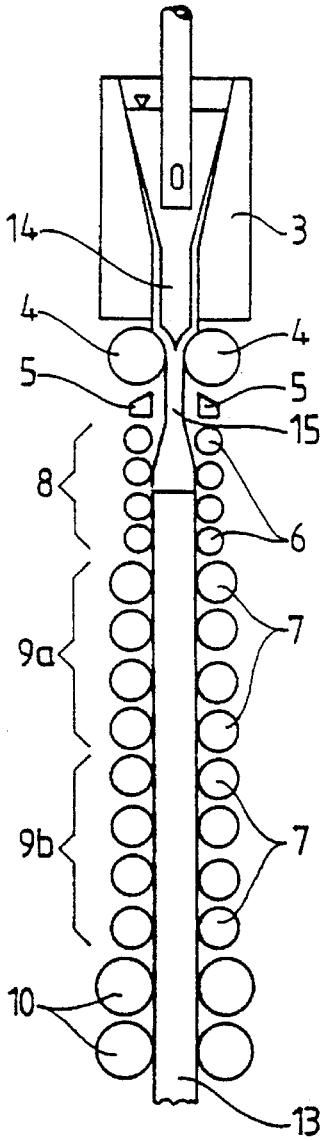
FIGS. 2–6 are schematic partial views of the plant of FIG. 1 showing adjustments of the strand guide elements during casting start-up to the desired final size of the thin slab.

As illustrated in FIG. 2, when the continuous casting plant 1 is started up, the strand guide grid 5, the strand guide rolls 6 and 7 of the first and second strand guide segments 8 and 9*a*, 9*b* as well as the drive rolls 10 are adjusted to the dimension of the dummy bar/hot strand corresponding to the outlet dimension of the mold. After a predetermined length of the strand has traveled through, the pair of reducing rolls 4, which are adjusted relative to the dummy bar 13 by pressure control, are adjusted to a smaller gap width and squeeze off the liquid core or crater 14. As a result, a strip-like start-up size 15 is formed whose thickness is below the thickness of the desired final size of the thin slab 2 illustrated in FIG. 1. After a predetermined casting length, for example, 1.5 meters, the thickness of the start-up size 15 is less than 30 mm.

Figure 3:
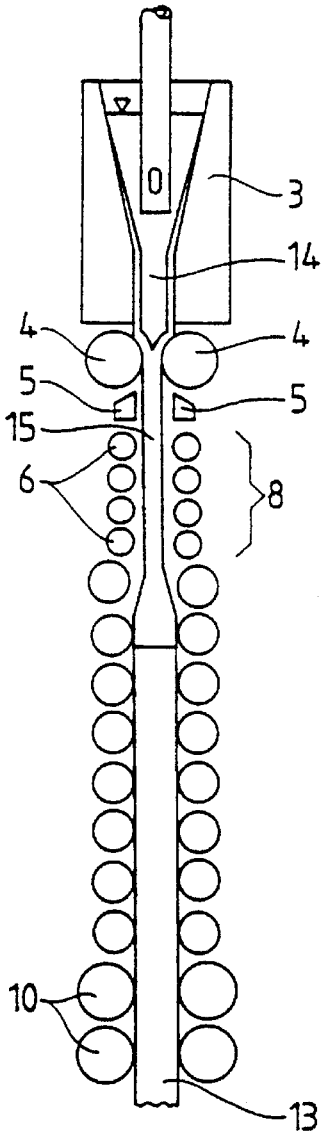

FIG. 3 shows that the dummy bar 13 has left the billet guide grid 5 and the strand guide roll 6 of the first strand guide segment 8. This means that it is possible to adjust the strand guide grid 5 and the strand guide rolls 6 to the thickness of the final size of the thin slab 2 which is greater than that of the start-up size 15.

Figure 4:
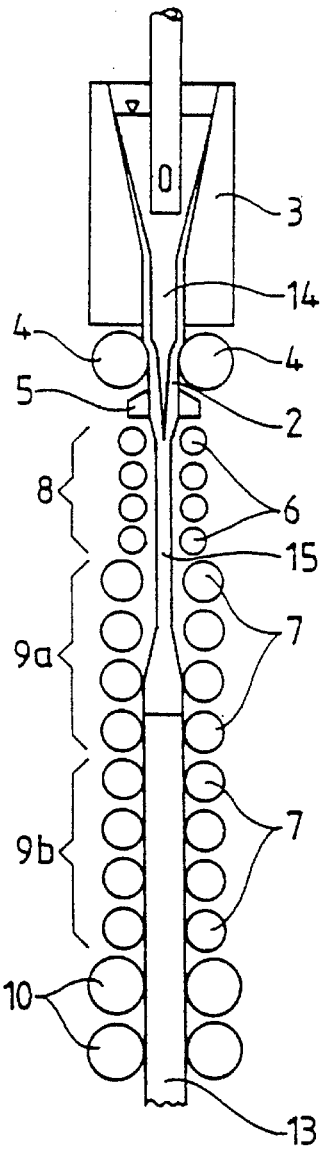

As can be seen in FIG. 4, the pair of reducing rolls 4 are subsequently positioned to the dimension of the desired final size, so that the thin slab 2 with the desired final size can be formed immediately following the start-up size 15.

Figure 5:
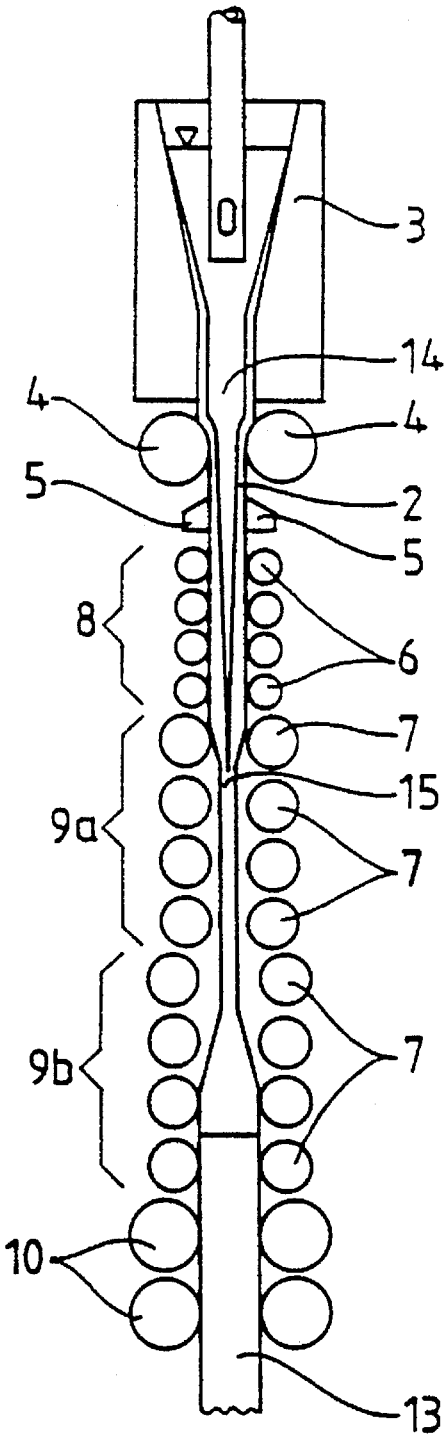
Figure 6:
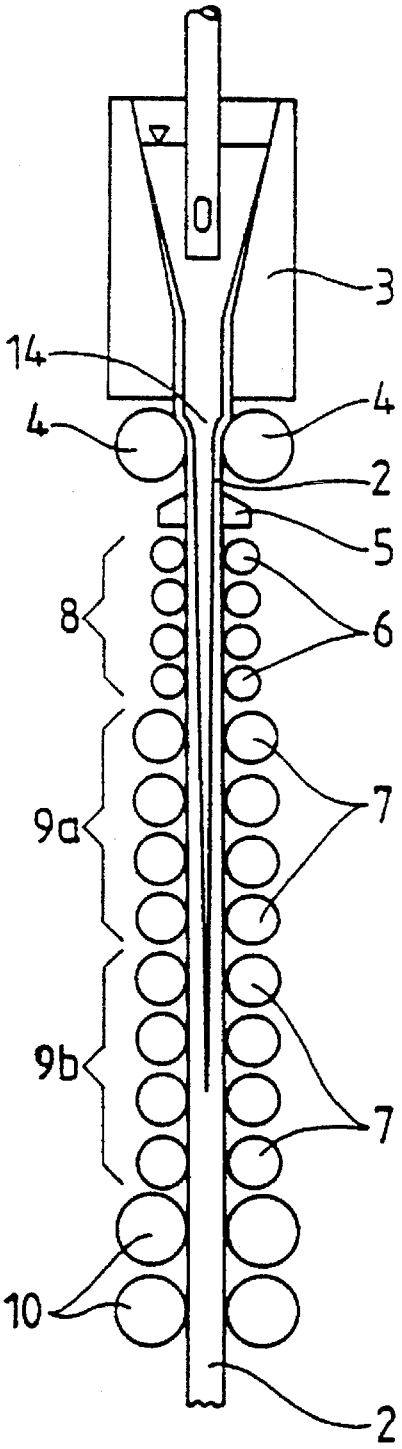

As the dummy bar/hot strand or the following start-up size 15 and the following thin slab 2 having the desired final size are progressively drawn out, initially the strand guide rolls 7 of the portion 9*a*, as shown in FIG. 5, and then the strand guide rolls 7 of the second portion 9*b* and the drive rolls 10, as shown in FIG. 6, are adjusted to the dimension of the final size. This adjustment is carried out when the start-up size 15 has completely reached the adjusting range, i.e., the range of the rolls which are to be adjusted individually or jointly.

Finally, the complete strand guide unit has been adjusted to the final size of the thin slab 2, as shown in FIGS. 1 and 6. The continuous casting plant 1 makes it possible to produce up to the casting end the thin slabs 2 which has the final size shown in FIG. 1 achieved by successively adjusting the strand guide elements. Of course, the dummy bar had previously been separated from the hot strand. This is achieved at start-up after the drive rolls 10 have been reached.

At the end of casting, not illustrated in the figures of the drawing, the end of the strand or the thin slab 2 is moved into the lower parallel portion of the open-ended mold 4 and is stopped for a short period during which the strand can form a shell which is closed to all sides. As a result, liquid steel is prevented to flow in the continuous casting machine out of the strand or the thin slab 2. For withdrawal the strand, the strand guide elements, i.e., strand guide grid 5 and strand guide rolls 6 and 7, and the pair of reducing rolls as well as the drive rolls 10 are moved apart to the dimension of the mold outlet.

The invention is not limited by the embodiments described above which are presented as examples only but can be modified in various ways within the scope of protection defined by the appended patent claims.

I claim:

1. A method of operating a continuous casting plant for the manufacture of thin slabs for hot strip rolling, wherein at least one pair of reducing rolls are arranged following a continuous casting mold and adjustable strand guide elements are arranged following the at least one pair of reducing rolls, the method comprising adjusting the pair of reducing rolls, after a predetermined length of strand has traveled through the pair of reducing rolls, to a gap between the reducing rolls which causes the liquid core of the strand to be squeezed off, deforming the strand by means of the pair of reducing rolls to a start-up size which has a thickness which is smaller than the thickness of a desired final size of the strand, and subsequently adjusting the pair of reducing rolls to the thickness of the final strand size as soon as a strand portion having the start-up size with the smaller thickness has completely reached the pair of reducing rolls and adjusting each strand guide elements to the thickness of the final strand size as soon as the strand portion having the start-up size with the smaller thickness has completely reached each strand guide element.

2. The method according to claim 1, wherein the pair of reducing rolls and the strand guide segments are adjusted successively.

3. The method according to claim 1, comprising adjusting the pair of reducing rolls by applying pressure against the reducing rolls toward the strand, and adjusting the pair of reducing rolls to the thickness of the final size of the strand, after adjusting the strand guide elements to the thickness of the final size of the strand.

4. The method according to claim 1, comprising adjusting the strand guide elements symmetrically relative to the strand guide center.

5. The method according to claim 1, comprising, at the end of the casting operation, moving an end of the strand into a lower portion of the mold and temporarily stopping the strand, subsequently adjusting the gap between the reducing rolls and a gap between the strand guide elements to a mold outlet size.

6. The method according to claim 1, comprising driving the pair of reducing rolls.

7. The method according to claim 1, comprising hydraulically adjusting the reducing rolls.

* * * * *